US007297862B2

(12) United States Patent
Nishitani et al.

(10) Patent No.: US 7,297,862 B2
(45) Date of Patent: Nov. 20, 2007

(54) MUSICAL TONE CONTROL APPARATUS AND METHOD

(75) Inventors: Yoshiki Nishitani, Hamakita (JP); Kenichi Miyazawa, Iwata-gun (JP); Masaharu Ono, Hamamatsu (JP); Nagayuki Kato, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 10/234,677

(22) Filed: Sep. 4, 2002

(65) Prior Publication Data

US 2003/0041721 A1 Mar. 6, 2003

(30) Foreign Application Priority Data

Sep. 4, 2001 (JP) ..... 2001-267951

(51) Int. Cl.
*G10H 3/00* (2006.01)

(52) U.S. Cl. ..... 84/723; 84/609; 84/615; 84/622; 84/735

(58) Field of Classification Search ..... 84/600–604, 84/609–612, 615, 622–626, 633–636, 649–653, 84/659–662, 665, 723, 725–726, 730–731, 84/735–737, 741
See application file for complete search history.

(56) References Cited

U.S. PATENT DOCUMENTS 5,027,688 A 7/1991 Suzuki et al.
5,046,394 A 9/1991 Suzuki et al.
5,058,480 A 10/1991 Suzuki et al.
5,177,311 A 1/1993 Suzuki et al.
5,192,823 A * 3/1993 Suzuki et al. ..... 84/600
5,278,346 A 1/1994 Yamaguchi
5,290,964 A 3/1994 Hiyoshi et al.
5,313,010 A 5/1994 Matsushima et al.
5,338,891 A * 8/1994 Masubuchi et al. ..... 84/600
5,373,096 A * 12/1994 Suzuki et al. ..... 84/600

(Continued)

FOREIGN PATENT DOCUMENTS

| | | |
|---|---|---|
| JP | 54-118223 | 9/1979 |
| JP | 01-243096 | 9/1989 |
| JP | 02-19197 | 2/1990 |
| JP | 04-33912 | 3/1990 |
| JP | 04-085598 | 3/1992 |
| JP | 4257920 | 9/1992 |
| JP | 04-294394 | 10/1992 |
| JP | 06-035466 | 2/1994 |
| JP | 09-127937 | 5/1997 |
| JP | 11-85153 | 3/1999 |

OTHER PUBLICATIONS

Japanese Office Action dated Nov. 16, 2005 and translation.

(Continued)

*Primary Examiner*—Marlon Fletcher
(74) *Attorney, Agent, or Firm*—Harness, Dickey & Pierce, PLC

(57) ABSTRACT

There is provided a musical tone control apparatus that enables a user to easily play a musical instrument without spoiling the user's feeling that he is actually playing a musical instrument. A storage device stores musical piece data containing interval data indicative of intervals of musical tones constituting a musical piece. A motion of an operator is detected. A controller provides control so as to instruct a musical tone output device capable of outputting musical tones to adopt the intervals as one of characteristic amounts relating to musical tones to be output from the musical tone output device, according to the interval data, and instruct the musical tone output device to adopt at least one of the characteristic amounts other than the intervals according to the detected motion of the operator.

17 Claims, 8 Drawing Sheets

U.S. PATENT DOCUMENTS

| | | | | |
|---|---|---|---|---|
| 5,396,025 | A * | 3/1995 | Tamura | 84/736 |
| 5,422,956 | A * | 6/1995 | Wheaton | 381/122 |
| 5,512,703 | A | 4/1996 | Usa | |
| 5,585,584 | A | 12/1996 | Usa | |
| 5,648,627 | A | 7/1997 | Usa | |
| 5,663,514 | A | 9/1997 | Usa | |
| 6,297,438 | B1 * | 10/2001 | Por Paul | 84/600 |
| 6,861,582 | B2 * | 3/2005 | Street | 84/600 |
| 6,969,795 | B2 * | 11/2005 | Hofmeister et al. | 84/600 |
| 2001/0015123 | A1 | 8/2001 | Nishitani et al. | |
| 2002/0088335 | A1 * | 7/2002 | Nishitani et al. | 84/600 |
| 2003/0041721 | A1 * | 3/2003 | Nishitani et al. | 84/609 |
| 2003/0101863 | A1 * | 6/2003 | Street | 84/723 |
| 2003/0196542 | A1 * | 10/2003 | Harrison, Jr. | 84/737 |
| 2005/0013662 | A1 * | 1/2005 | Provenzano, III | 404/75 |

OTHER PUBLICATIONS

Submission of Publication filed in the basic Japanese patent application No. 2001-267961 and English translations thereof.

Japanese Office Action dated Feb. 14, 2006 issued on Japanese Patent Application No. 2001-267951.

* cited by examiner

| | | | | | |
|---|---|---|---|---|---|
| MUSICAL PIECE A | DO (C) | MI (E) | SO (G) | · · · · · | SO (G) |
| MUSICAL PIECE B | DO (C) | RE (D) | MI (E) | · · · · · | MI (E) |
| ⋮ | | | ⋮ | | |

MUSICAL TONE CONTROL APPARATUS AND METHOD

BACKGROUND OF THE INVENTION

1. Field of the invention

The present invention relates to a musical tone control apparatus and method for controlling generation of musical tones.

2. Description of the Related Art

As is well known, various musical expressions can be provided using various natural instruments including keyboard instruments such as piano and organ, string instruments such as violin and guitar, and wind instruments such as trumpet and flute. Further, electronic instruments such as electronic piano and organ can be used to provide musical expressions as rich as those of the natural instruments.

The manner of playing a musical piece is characterized by controlled amounts of various characteristics (such as rhythm, volume, and interval (hereinafter referred to as "characteristic amounts"). Therefore, in order for a player to provide a desired musical expression using a musical instrument, he or she must select and output specific musical tones with appropriate rhythm and volume. However, it is very difficult for a beginner, who is not accustomed to playing a musical instrument, to properly select all these characteristic amounts for performance.

On the other hand, what is called Desk Top Music enables the user to play a desired musical piece by using a personal computer to input various characteristic amounts for musical tones to the computer. Thus, even a beginner can relatively easily provide various performances. However, with this method, the user cannot have a feeling that he is actually playing a musical instrument. Therefore, those who desire to enjoy actual operations of playing a musical instrument are not always satisfied with this method.

SUMMARY OF THE INNOVATION

It is an object of the present invention to provide a musical tone control apparatus and method that enable a user to easily play a musical instrument without spoiling the user's feeling that he is actually playing a musical instrument.

To attain the above object, in a first aspect of the present invention, there is provided a musical tone control apparatus comprising a storage device that stores musical piece data containing interval data indicative of intervals of musical tones constituting a musical piece, a detecting device that detects a motion of an operator, and a controller that provides control so as to instruct a musical tone output device capable of outputting musical tones to adopt the intervals as one of characteristic amounts relating to musical tones to be output from the musical tone output device, according to the interval data, and instruct the musical tone output device to adopt at least one of the characteristic amounts other than the intervals according to the motion of the operator detected by the detecting device.

In a preferred form of the present invention, the controller instructs the musical tone output device to adopt timing corresponding to the motion of the operator as timing in which each of the musical tones constituting the musical piece is to be output.

In a more preferred form of the present invention, the musical tone control apparatus according to the present invention further comprises an operating element operated by the operator, and wherein the detecting device detects an operation made on the operating element, and the controller instructs the musical tone output device to adopt timing corresponding to the operation made on the operating element as timing in which at least one associated musical tone of the musical tones constituting the musical tone is to be output.

Preferably, the operating element is disposed to reciprocate along a particular direction according to the motion of the operator, and the controller is responsive to the operating element being moved, for instructing the musical tone output device to output at least one associated musical tone of the musical tones constituting the musical piece.

More preferably, the controller is responsive to the operating means being moved in one direction along the particular direction, for instructing the musical tone output device to output at least one associated musical tone of the musical tones constituting the musical piece.

Also preferably, the operating element comprises a pair of members joined together via a telescopic joining member, and the controller is responsive to at least one of the pair of members being moved away from each other and the pair of members being moved toward each other according to the motion of the operator, for instructing the musical tone controller to output at least one associated musical tone of the musical tones constituting the musical piece.

In a preferred example, the operating element comprises strings that are vibrated in response to the motion of the operator, and the controller is responsive to the strings being vibrated, for instructing the musical tone output device to output at least one associated musical tone of the musical tones constituting the musical piece.

In a preferred form of the present invention, the controller instructs the musical tone output device to adopt volume corresponding to the motion of the operator as the volume of the musical tones to be output from the musical tone output device.

Preferably, the detecting device detects a posture of the musical tone control apparatus which changes depending on the motion of the operator, and the controller instructs the musical tone output device to adopt a volume corresponding to the posture of the musical tone control apparatus, as a volume with which the musical tones to be output from the musical tone output device.

In a more preferred form of the present invention, the musical tone control apparatus according to the present invention further comprises an operating element operated by the operator, and wherein the detecting device detects an motion made on the operating element, and the controller instructs the musical tone output device to carry out or stop output of the musical tones based on the musical piece data, depending on the operation detected by the detecting device.

In this case, it is preferable that the controller is responsive to the operating element being operated, for instructing the musical tone output device to carry out the output of the musical tones and responsive to the operating element not being operated, for instructing the musical tone output device to stop the output of the musical tones.

It is also preferable that the controller instructs the musical tone output device to adopt a tempo corresponding to the motion of the operator, as a tempo at which the output of the musical tones is carried out.

It is preferable that the musical tone output device is provided in one body with the musical tone controller.

To attain the above object, in a second aspect of the present invention, there is provided a musical tone control method comprising the steps of causing a storage device to store musical piece data containing interval data indicative of intervals of musical tones constituting a musical piece, detecting a motion of an operator, and instructing a musical tone output device capable of outputting musical tones to adopt the intervals as one of characteristic amounts relating to musical tones to be output from the musical tone output device, according to the interval data, and instructing the musical tone output device to adopt at least one of the characteristic amounts other than the intervals according to the detected motion of the operator.

According to the present invention, the intervals of musical tones constituting a musical piece are determined based on interval data stored in advance, whereas the characteristic amounts relating to musical tones other than the intervals are determined according to the operator's motion detected by the detecting device. As a result, the operator, who plays the musical piece, need not pay special attention to the intervals of musical tones and can thus easily play the musical piece. On the other hand, the characteristic amounts relating to the musical tones other than the intervals are adjusted according to the operator's motion, thereby avoiding spoilage of the operator's feeling that he is actually playing musical instrument.

The above and other objects, features and advantages of the Invention will become more apparent from the following detailed description taken in conjunction with the accompanying drawings.

DETAILED DESCRIPTION OF THE PREFERRED EMBODIMENTS

The present invention will be now described with reference to the drawings showing preferred embodiments thereof. The embodiments shown below illustrate preferred embodiments of the present invention and do not limit the present invention. The embodiments can be arbitrarily changed within the scope of the present invention.

Figures 1, 2:
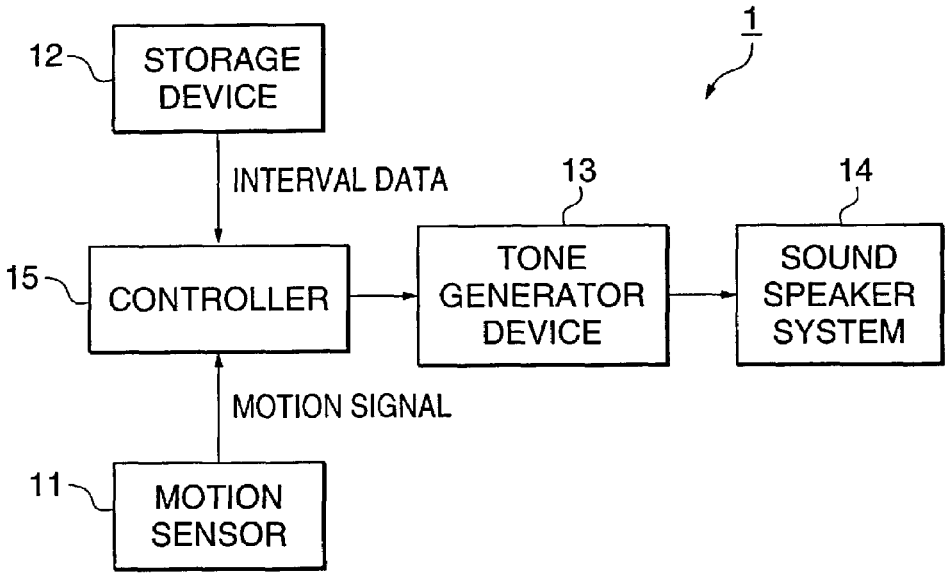
FIG. 1 is a block diagram showing the functional construction of a musical tone control apparatus according to a first embodiment of the present invention.
FIG. 2 is a view showing an example of the contents of musical piece data for use in the musical tone control apparatus in FIG. 1.

First, the construction of a musical tone control apparatus according to a first embodiment of the present invention will be described with reference to FIG. 1. As shown in FIG. 1, the musical tone control apparatus 1 according to the present embodiment is comprised of a motion sensor 11, a storage device 12, a tone generator device 13, a sound speaker system 14, and a controller 15.

The motion sensor 11 is means for detecting the motion of an operator of the musical tone control apparatus 1. Specifically, the motion sensor 11 may be an acceleration sensor, a speed sensor, and a tilt sensor, and is disposed to output a signal corresponding to the operator's motion (hereinafter referred to as the "motion signal"), to the controller 15. Motions to be detected by the motion sensor 11 include, for example, a motion of the operator operating a predetermined operating element, and a motion of the operator tilting the musical tone control apparatus 1. The specific contents of the motions will be described later in detail.

The storage device 12 stores musical piece data corresponding to a musical piece to be played, and is comprised of a storage medium such as a floppy disk (registered trade name) or a CD-ROM, and a readout device that reads out data stored in the storage medium. The storage device 12 (more specifically, the storage medium constituting the storage device 12) stores musical piece data of a plurality of musical pieces. Here, FIG. 2 is a view showing an example of the contents of the musical piece data. As shown in the figure, the musical piece data are stored in correspondence to the respective musical pieces. Musical piece data corresponding to one musical piece contains interval data (in FIG. 2, "do (C)", "mi (E)", and others) indicative of the intervals of a plurality of musical tones constituting the musical piece, the interval data being arranged in the order corresponding to the arrangement of the musical tones constituting the musical piece.

The tone generator device 13, shown in FIG. 1, is means for generating musical tone signals corresponding to musical tones to be output and outputting the musical tone signals to the sound speaker system 14. More specifically, when the controller 15 designates characteristic amounts for musical tones, the tone generator device 13 generates musical tone signals corresponding to the musical tones specified by these characteristic amounts, and outputs the musical tone signals to the sound speaker system. The sound speaker system 14 is comprised of, for example, an amplifier, and a speaker, and outputs via the speaker musical tones corresponding to the musical tone signal supplied from the tone generator device 13.

The controller 15 is comprised of a CPU (Central Processing Unit), and functions as a control center of the musical tone control apparatus such that it transmits and receives various kinds of information to and from the storage device 12 and the tone generator device 13. More specifically, the controller 15 instructs the tone generator device 13 to adopt characteristic amounts for musical tones for which musical tone signals are to be generated, based on interval data stored in the storage device 12 and the motion signal supplied from the motion sensor 11. Here, the characteristic amounts for musical tones are parameters that characterize the musical tones, for example, interval, tone generation timing, volume, and tone color. However, in the present embodiment, it is assumed that the controller 15 instructs the tone generator device 13 to adopt interval, tone generation timing, and volume as characteristic amounts for musical tones for which musical tone signals are to be generated.

More specifically, the controller 15 instructs or designates an interval indicated by interval data in the musical piece data stored in the storage device 12, as the interval of a musical tone for which a musical tone signal is to be generated by the tone generator device 13. Thus, the interval of musical tones output from the sound speaker system 14 is determined based on the contents of the musical piece data irrespective of the operator's intention. On the other hand, the controller 15 instructs the tone generator device 13 to adopt characteristic amounts for musical tones other than the interval, i.e. tone generation timing and volume, based on the motion signal output from the motion sensor 11. Thus, the characteristic amounts other than the interval for musical tones output from the sound speaker system 14 reflect the motion signal output from the motion sensor 11, i.e. the contents of the operator's motion. For example, upon recognizing a specific motion made by the operator based on the motion signal supplied from the motion sensor 11, the controller 15 outputs interval data in the musical piece data to the tone generator device 13 in timing in which the above motion is made. As a result, whenever the operator makes a specific motion, musical tones constituting the musical piece are sequentially output. On the other hand, when the operator makes another motion, the controller 15 instructs the tone generator device 13 to adopt a volume corresponding to this motion.

The musical tone control apparatus according to the present embodiment is basically constructed as described above. Specific examples of the musical tone control apparatus according to the present embodiment will be described hereinbelow.

Figure 3A:
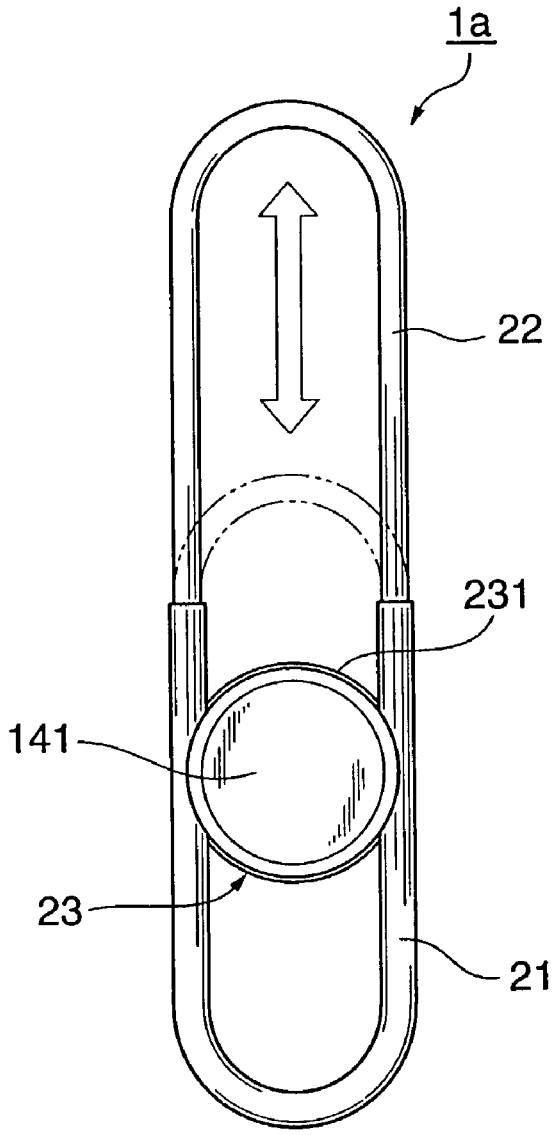
FIG. 3A is a plan view showing the appearance of an first example of the musical tone control apparatus in FIG. 1.
Figure 3B:
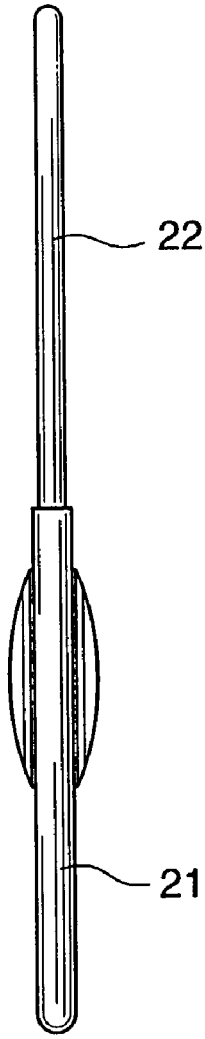
FIG. 3B is a side view of the musical tone control apparatus in FIG. 3A.

FIG. 3A is a plan view showing the appearance of a musical tone control apparatus according to a first example of the present embodiment. FIG. 3B is a side view corresponding to FIG. 3A. As shown in these figures, the musical tone control apparatus 1*a* according to the first example is comprised of a support section 21, a slider 22, and a main body section 23. The support section 21 is a tubular member bent in a U form. The slider 22 is a tubular member bent in a U form similarly to the support section 21, with the opposite ends of the slider 22 being inserted into the corresponding ends of the support section 21. With this construction, the operator can repeatedly move the slider 22 into an arbitrary position between a position in which the slider 22 is fully drawn out from the support section 21 (the position shown by the solid lines in FIG. 3A) and a position in which the slider 22 is deeply inserted into the support section 21 (the position shown by the dotted lines in FIG. 3A).

The main body section 23 is comprised of the elements shown in FIG. 1, described previously, and a housing 23 that accommodates these elements. The housing 231 is shaped generally like a disk. A peripheral edge of the housing 231 is partially fixed to a pair of straight portions of the support section 21 which extend parallel with each other. Further, a speaker 141 constituting the sound speaker system 14 is provided on one of opposite circular side surfaces of the housing 23.

Figure 4:
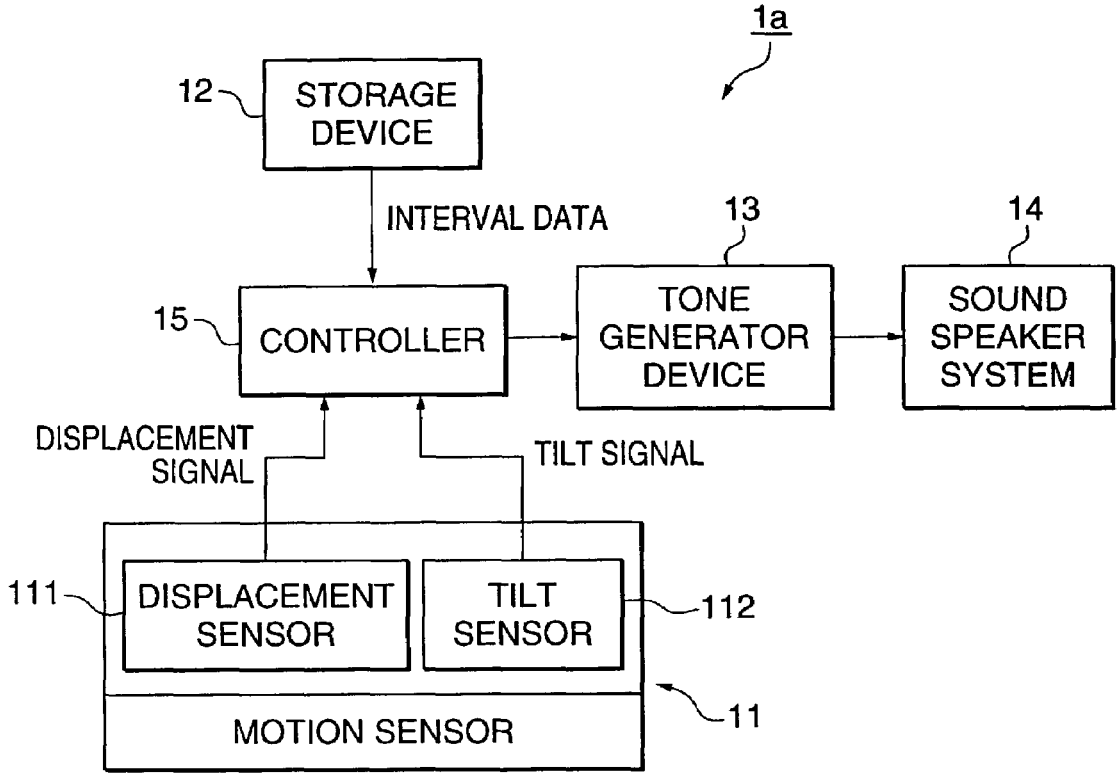
FIG. 4 is a block diagram showing the functional construction of the musical tone control apparatus in FIGS. 3A and 3B.

Furthermore, as shown in FIG. 4, the musical tone control apparatus 1*a* according to the present example includes a displacement sensor 111 and a tilt sensor 112 as the motion sensor 11, shown in FIG. 1 and described previously. The displacement sensor 111 outputs a signal corresponding to a position of the slider 22 with respect to the support section 21 (hereinafter referred to as the "displacement signal"), to the controller 15. On the other hand, the tilt sensor 112 outputs a signal corresponding to a tilt (i.e. posture) of the musical tone control apparatus 1*a* (hereinafter referred to as the "tilt signal"), to the controller 15. That is, the displacement signal reflecting the operator's motion of moving the slider 22 (hereinafter referred to as the "slide motion") and the tilt signal reflecting the operator's motion of tilting the musical tone control apparatus 1*a* are output to the controller 15 as the above described motion signal. Then, the controller 15 controls tone generation timing for musical tones according to the contents of the displacement signal. That is, the controller 15 gives an instruction to the tone generator device 13 such that musical tones are output while the operator is making a slide motion and the output of musical tones is stopped when the operator does not make a slide motion. Furthermore, the controller 15 controls the volume of musical tones to be output, according to the contents of the tilt signal.

Now, a description will be given of the operation of the musical tone control apparatus 1*a* according to the present example.

First, the operator performs predetermined operations on keys, not shown, provided on the main body section 23 to instruct the musical tone control apparatus 1*a* to select a musical piece to be played and to start playing the musical piece. Upon receiving the instruction, the controller 15 instructs the tone generator device 13 to generate musical tone signals based on the contents of the musical piece data stored in the storage device 12 and according to the motion signal (displacement signal and tilt signal) supplied from the motion sensor 11. The details of this process will now be described below with reference to FIG. 5. In the graph shown in FIG. 5, the ordinate represents the position x of the slider 22, which varies with the operator's slide motion, while the abscissa indicates time t. The position x indicates the position of the slider 22 with respect to the support section 21, the position x being set to "0" when the slider 22 is at a particular position. Further, it is assumed here that a musical piece A, shown in FIG. 2, is selected, i.e. a musical piece in which musical tones "do (C)", "mi (E)", "so (G)", . . . are arranged in this order is played.

Figure 5:
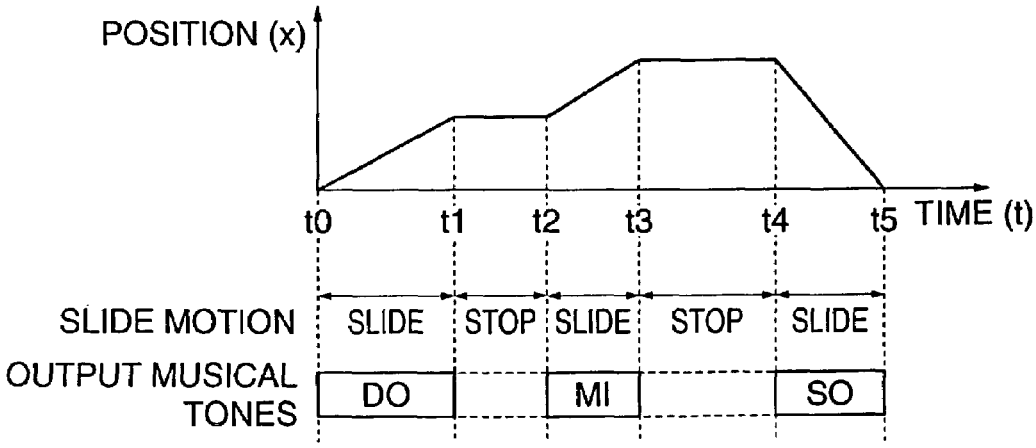
FIG. 5 is a view useful in explaining the operation of the musical tone control apparatus in FIGS. 3A and 3B.
Figure 6:
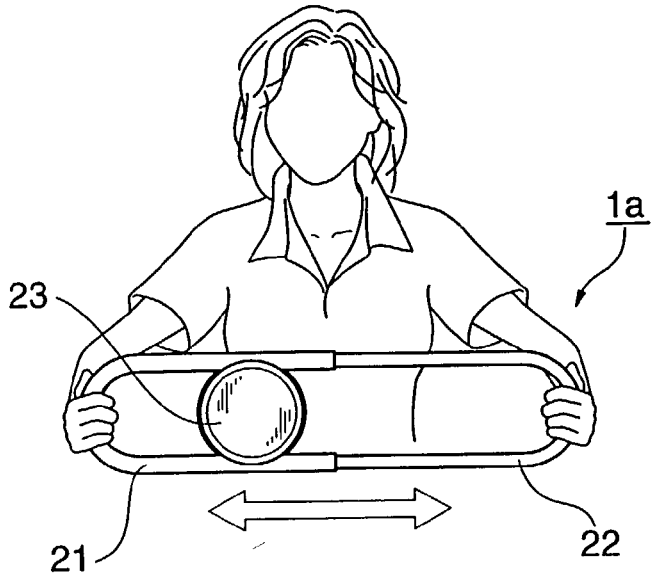
FIG. 6 is a view showing an example of operation of the musical tone control apparatus in FIGS. 3A and 3B.

First, let it assumed that the operator holds the musical tone control apparatus 1*a* in his or her hands as shown in FIG. 6, and moves the slider 22 away from the support section 21 (the direction indicated by the arrow in the figure) at a time point t0. Upon recognizing the start of this slide motion based on the displacement signal supplied from the displacement sensor 111, the controller 15 outputs, to the tone generator device 13, interval data indicative of the interval of the first musical tone "do" and contained in musical piece data corresponding to the musical piece A which is stored in the storage device 12. Upon receiving this interval data, the tone generator device 13 generates a musical tone signal corresponding to the interval data indicative of the interval of the musical tone "do" and outputs it to the sound speaker system 14. As a result, as shown in FIG. 5, the speaker 141 outputs the musical tone "do". Then, at a time point t1, upon recognizing the stoppage of the slide motion (i.e. the stoppage of a change in the position x) from the displacement signal, the controller 15 instructs the tone generator device 13 to stop the musical tone "do" from being output. As a result, the output of the musical tone signal from the tone generator device 13 and the output of the musical tone "do" from the speaker 141 are stopped. In this way, the musical tone "do" is continuously output throughout the time period during which the slide motion is made.

Then, when a slide motion is started again at a time point t2, the controller 15 outputs interval data indicative the interval of the next musical tone "mi" in the musical piece data to the tone generator device 13. As a result, the tone generator device 13 generates a musical tone signal corresponding to the interval data indicative of the interval of the musical tone "mi" and the speaker 141 outputs the musical tone "mi". Similar operations are subsequently carried out. As a result, during each time period when the operator makes a slide motion, the speaker 141 outputs a musical tone or musical tones (in the present embodiment, one musical tone), and thus musical tones constituting the musical piece are output from the speaker 141 in the order in which the musical tones constitute the musical piece.

Figure 7:
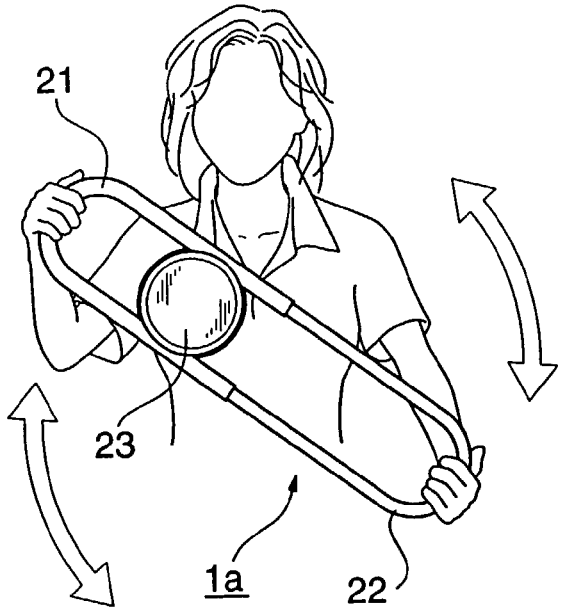
FIG. 7 is a view showing an example of operation of the musical tone control apparatus in FIGS. 3A and 3B.

On the other hand, as shown in FIG. 7, when the operator tilts the musical tone controller 1*a*, the tilt sensor 112 outputs a tilt signal corresponding to this tilt. Upon receiving the tilt signal, the controller 15 instructs the tone generator device 13 to adopt a volume corresponding to the degree of tilt indicated by the tilt signal. Upon receiving the instruction via the tone generator device 13, the sound speaker system 14 adjusts the volume of musical tones to be output, to the value of the instructed volume.

In this way, according to the present example, each of musical tones constituting a musical piece is output in timing according to a slide motion and with a volume according to a tilt of the musical tone control apparatus 1*a*. As a result, the operator can very easily play a musical piece without paying special attention to musical tones. On the other hand, the operator can adjust the tone generation timing and volume as desired according to his own motion. This avoids spoilage of the operator's feeling that he is actually playing, as well as significant limitation of his or her musical expressions.

In the present example, the output of musical tones is switched depending on whether or not the operator is making a slide motion. However, the output and/or stoppage of musical tones may be switched depending on the direction of a slide motion. For example, musical tones may be output when the operator makes a slide motion so as to move the slider 22 away from the support section 21. On the other hand, the output of musical tones may be stopped when the operator makes a slide motion in the opposite direction, i.e. so as to move the slider 22 toward the support section 21, or stops the slide motion. In this case, in place of the displacement sensor 111, shown in FIG. 4, a pressure sensor may be used which detects pressure in the tube formed by the slider 22 and support section 21, to output a pressure signal corresponding to the pressure. That is, it may be arranged such that when the pressure signal indicates negative pressure, the controller 15 determines that the slider 22 is moving away from the support section 21 and instructs the tone generator device 13 to output musical tones, whereas, when the pressure signal indicates positive pressure, the controller 15 determines that the slider 22 is moving toward the support section 21 and instructs the tone generator device 13 to stop musical tones from being output.

Figure 8:
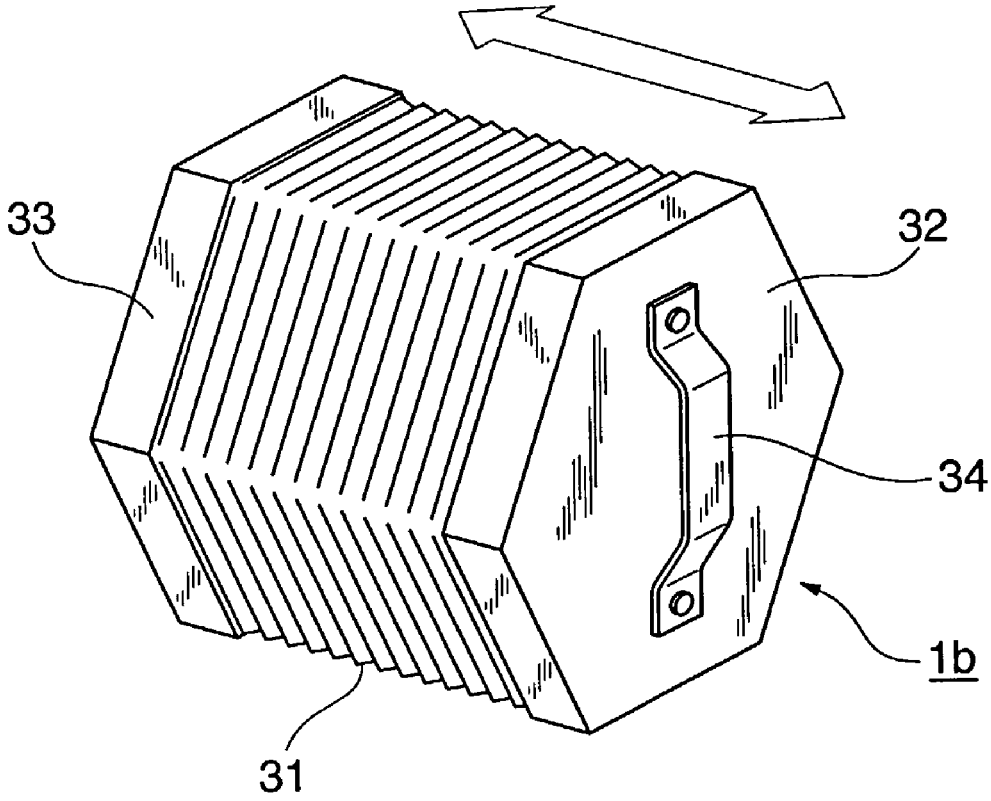
FIG. 8 is a perspective view showing the appearance of a second example of the musical tone control apparatus in FIG. 1.

FIG. 8 is a perspective view showing the appearance of a musical tone control apparatus according to a second example of the present embodiment. As shown in FIG. 8, the musical tone control apparatus 1*b* according to the second example is comprised of telescopic bellows 31, and a first body portion 32 and a second body portion 33 connected together via the bellows 31, and thus the apparatus 1*b* is generally shaped like an accordion (concertina). The first body portion 32 and the second body portion 33 are each provided with a belt 34 to fix the operator's hand. With this construction, the operator, with the right and left hands fixed to the first and second body portions 32 and 33, respectively, using the belts 34, moves the body portions toward or away from each other.

The first body portion 32 accommodates the elements shown in FIG. 1. However, the musical tone control apparatus 1*b* according to the present example is provided, as the motion sensor 11, with a pressure sensor that outputs a pressure signal corresponding to wind pressure inside the bellows 31 and a tilt sensor that outputs a tilt signal corresponding to the tilt of the musical tone control apparatus 1*b* (more specifically, the first body portion 32). With this arrangement, the controller 15 receives the pressure signal from the pressure sensor and the tilt signal from the tilt sensor as the motion signal according to the operator's motion, to control the tone generation timing and volume of musical tones based on these motion signals, as in the case of the above described first example.

That is, when the operator moves the first and second body portions 32 and 33 toward each other or away from each other (hereinafter referred to as an "opening and closing motion"), the pressure sensor outputs a pressure signal corresponding to a change in the pressure inside the bellows 31 associated with this opening or closing motion. Upon receiving the pressure signal to recognize the start of the opening and closing motion, the controller 15 outputs, to the tone generator device 13, interval data corresponding to the first musical tone of the musical piece and contained in the musical piece data stored in the storage device 12. As a result, the tone generator device 13 generates a musical tone signal corresponding to the interval data. Then, the speaker system 14 outputs a musical tone corresponding to the musical tone signal. On the other hand, when the operator stops the opening or closing motion, the controller 15 recognizes the stoppage of the motion based on a change in the pressure signal, to instruct the tone generator device 13 to stop the musical tone from being output. As a result, the output of the musical tone from the sound speaker system 14 is stopped. Thereafter, similar operations are executed according to the operator's motion. As a result, during each time period when the operator makes an opening or closing motion, a musical tone is output, and thus musical tones constituting the musical piece are sequentially output.

On the other hand, when the operator 32 tilts the first body portion 32, the tilt sensor outputs a tilt signal corresponding to the tilt motion. Upon receiving the tilt signal, the controller 15 instructs the sound speaker system 14 to adopt a volume corresponding to the degree of tilt indicated by the tilt signal. Upon receiving the instruction, the sound speaker system 14 adjusts the volume of musical tones to be output, to the value of the instructed volume.

Figure 9:
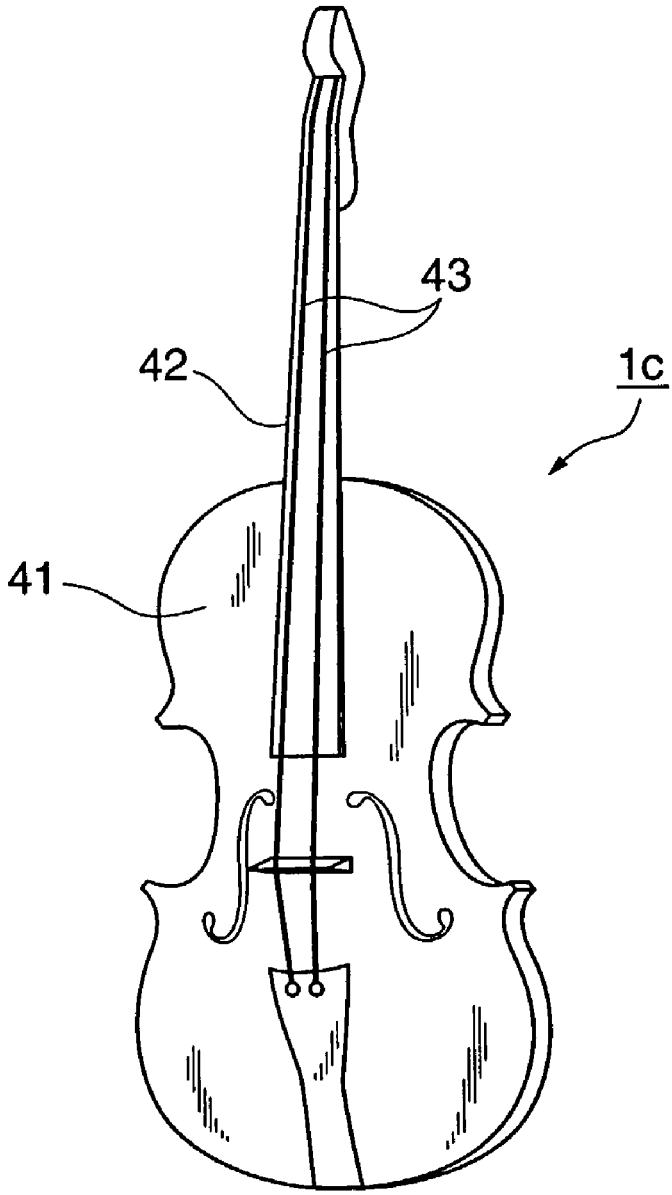
FIG. 9 is a perspective view showing the appearance of a third example of the musical tone control apparatus in FIG. 1.

FIG. 9 is a perspective view showing the appearance of a musical tone control apparatus according to a third example of the present embodiment. As shown in FIG. 9, the musical tone control apparatus 1*c* according to the present example is comprised of a body portion (resonating body portion) 41, a neck 42 projecting from the body portion 41, and strings 43 extended from the body portion 41 to the neighborhood of one end of the neck 42, and the apparatus 1C is generally shaped like an ordinary violin. However, the musical tone control apparatus 1*c* differs from ordinary violins, which are typically four-stringed, in that it has only two strings 43. With this construction, the operator can vibrate the strings 43 by picking the strings 43 with fingers or rubbing the strings 43 using a bow.

The body portion 41 accommodates the elements shown in FIG. 1. However, the musical tone control apparatus 1*c* according to the present example is provided, as the motion sensor 11, with a vibration sensor that outputs a signal corresponding to vibration imparted to the strings 43 (hereinafter referred to as the "vibration signal") and a tilt sensor that outputs a tilt signal corresponding to the tilt of the musical tone control apparatus 1*c*. With this arrangement, the controller 15 receives the motion signal (vibration signal and tilt signal) from the motion sensor 11 having the vibration sensor and tilt sensor, to control the tone generation timing and volume of musical tones to be output based on the motion signal, as in the case of the above described first and second examples.

That is, when the operator 43 vibrates the strings 43, the vibration sensor outputs a vibration signal corresponding to the vibration. Upon receiving the vibration signal to recognize the vibration of the string 43, the controller 15 outputs, to the tone generator device 13, interval data indicative of the interval of the first musical tone of the musical piece and contained in the musical piece data stored in the storage device 12. Then, the tone generator device 13 generates a musical tone signal corresponding to the interval data. Thereafter, the speaker system 14 outputs a musical tone corresponding to the musical tone signal. On the other hand, when the amplitude of the vibration imparted to the string 43 attenuates to or below a predetermined threshold, the controller 15 recognizes the attenuation of the vibration from the vibration signal output from the vibration sensor, to instruct the tone generator device 13 to stop the musical tone from being output. As a result, the output of the musical tone is stopped as the vibration attenuates. Thereafter, similar operations are carried out whenever the operator vibrates the strings by picking them or rubbing them using a bow. As a result, during each time period when the strings 43 are vibrated, a musical tone is output, and thus musical tones constituting the musical piece are sequentially output.

On the other hand, when the operator tilts the musical tone control apparatus 1*c*, a process similar to that executed in the first and second examples is executed to adjust the volume of musical tones to be output, to a value corresponding to the tilt of the musical tone control apparatus 1*c*.

Figure 10:
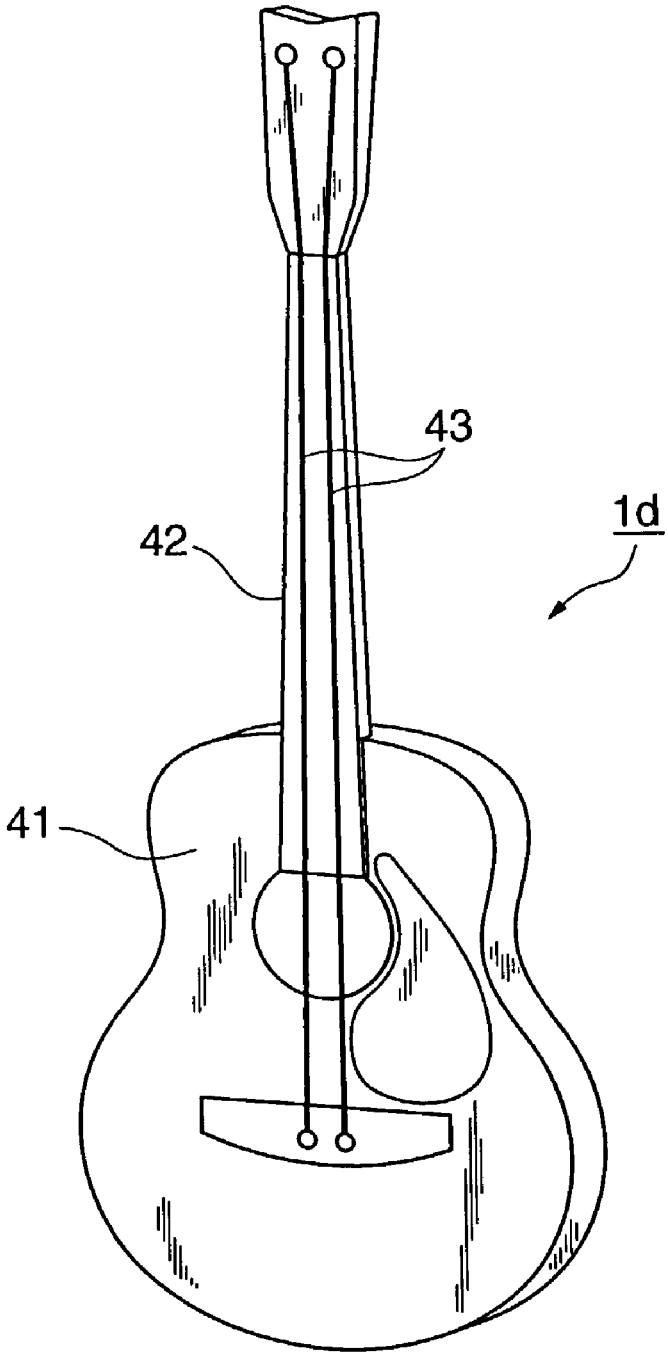
FIG. 10 is a perspective view showing the appearance of a variation of the third example of the musical tone control apparatus in FIG. 1.

In the present example, the violin-type musical tone control apparatus 1*c* is illustrated. However, the technical concept of the present example is applicable to a musical tone control apparatus 1*d* which is shaped like an acoustic guitar, as illustrated in FIG. 10. That is, also the musical tone control apparatus 1*d* may be constructed such that during each time period when the strings 43 are vibrated, one of musical tones constituting a musical piece is output so that the musical tones are sequentially output, while the volume of the musical tones is adjusted to a value corresponding to the tilt of the musical tone control apparatus 1*d*.

Figure 11:
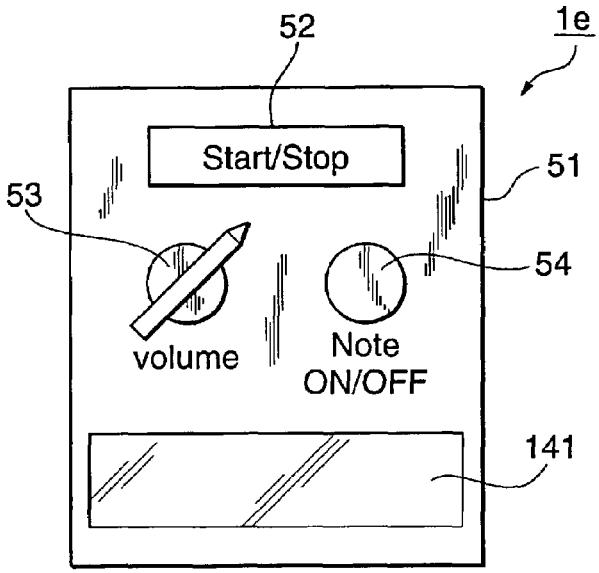
FIG. 11 is a perspective view showing the appearance of a fourth example of the musical tone control apparatus in FIG. 1.

In the above examples, the illustrated musical tone control apparatuses are each shaped like a certain musical instrument (or a part thereof). However, as a simpler construction, for example, a construction as shown in FIG. 11 may be employed. That is, this musical tone control apparatus 1*e*is comprised of the elements shown in FIG. 1, described previously, and a housing 51 having a rectangular parallelepiped configuration and accommodating these elements. The housing 51 is provided, on one side surface thereof, with a speaker 141 constituting the sound speaker system 14, an operating switch 52 for instructing the apparatus to start and stop playing a musical piece, a performance operating switch 54 for instructing, for the tone generator device, tone generation timing for musical tones to be output, and a volume control knob 53 for adjusting the volume of musical tones to be output. Furthermore, the musical tone control apparatus 1*e* according to the present manner is provided, as the motion sensor 11 shown in FIG. 11, described previously, a sensor that outputs a signal corresponding to an operation of depressing the performance operating switch 54, and a sensor that outputs a signal corresponding to an operation given to the volume control knob 53.

With this construction, when the operating switch 52 has been depressed to designate the start of a performance, and then the controller 15 recognizes the depression of the performance operating switch 54 from an output signal from the motion sensor 11, the controller 15 outputs interval data indicative of the interval of the first musical tone of a musical piece contained in the musical piece data stored in the storage device 12. As a result, the speaker 141 outputs the musical tone. On the other hand, upon recognizing depression release of the performance operating switch 54 from an output signal from the motion sensor 11, the controller 15 gives the tone generator device 13 an instruction for stopping a musical tone from being output. Thus, the output of musical tones is stopped. Thereafter, whenever the performance operating switch 54 is depressed or released, similar operations are carried out, and thus, during each time period when the performance operating switch 54 is depressed, each of the musical tones constituting the musical piece is output, so that the musical tones are sequentially output.

On the other hand, upon recognizing an operation (rotation) of the volume control knob 53 from an output signal from the motion sensor 11, the controller 15 instructs the sound speaker system 14 to adopt a volume corresponding to the rotational angle of the volume control knob 53. As a result, the volume of musical tones output from the speaker 141 is adjusted according to the operator's operation of the volume control knob 53 (i.e. motion of operating the knob 53).

As described above, according to the present embodiment, out of the characteristic amounts for each of musical tones constituting a musical piece, the interval is determined based on the already stored interval data. Therefore, the operator can easily play the musical piece without paying special attention to the interval. Further, according to the present embodiment, the characteristic amounts for musical tones other than the interval (tone generation timing and volume) are determined according to the operator's motion, whereby the motion of the operator can be reflected upon the performance of a musical piece, making it possible to avoid spoilage of the operator's feeling that he is actually playing the musical piece.

Now, a musical tone control apparatus according to a second embodiment of the present invention will be described. In the above described first embodiment, musical tones constituting a musical piece are sequentially output according to the operator's motions. In contrast, in the musical tone control apparatus according to the present embodiment, the progress and stoppage of performance of a musical piece are switched depending on the operator's motions. Further, in the present embodiment, the performance tempo of a musical piece can be changed according to the operator's motion as desired. This will be described below in detail.

The functional construction of the musical tone control apparatus according to the present embodiment is similar to that shown in FIG. 1, described previously. However, in the present embodiment, musical piece data corresponding to each musical piece conforms to, for example, the MIDI (Musical Instrument Digital Interface) Standard, and contains data indicative of the contents of performance of a plurality of parts (a plurality of musical instruments having different tone colors).

The controller 15 instructs the tone generator device 13 to play a musical piece based on musical piece data. Then, a musical tone signal is generated based on the musical piece data, and the sound speaker system 14 outputs performance sound. However, the controller 15 in the present embodiment instructs the tone generator device 13 to progress or stop performance of a musical piece according to a motion detected by the motion sensor 11. More specifically, the controller 15 determines whether or not the operator is making a specific motion, based on the motion signal from the motion sensor 11. If the tone generator device 13 to play the musical piece. On the other hand, if the specific motion is not being made, the controller 15 instructs the tone generator device 13 to stop playing the musical piece. Furthermore, the controller 15 provides such control that the performance tempo of the musical piece matches the operator's motion. For example, if the operator quickly makes a specific motion, the musical piece is played with a fast tempo, whereas, if the operator slowly makes the specific motion, the musical piece is played with a slow tempo.

Then, the details of operation of the musical tone control apparatus according to the present embodiment will be described. The musical tone control apparatus according to the present embodiment may employ any of the forms shown in FIG. 3 or FIGS. 8 to 11, described previously. In the following description, the slider-type musical tone control apparatus 1*a*, given as the first example, will be taken by way of example. That is, in this case, musical tone performance is carried out when the operator is making a slide motion, while the musical tone performance is stopped when the operator stops the slide motion. Further, the tempo of the performance is determined based on the speed of the slide motion. A specific example of the motion will be described below with reference to FIG. 12. The volume of a musical piece is properly adjusted to a value corresponding to the tilt of the musical tone control apparatus detected by the tilt sensor, as in the case of the first embodiment.

Figure 12:
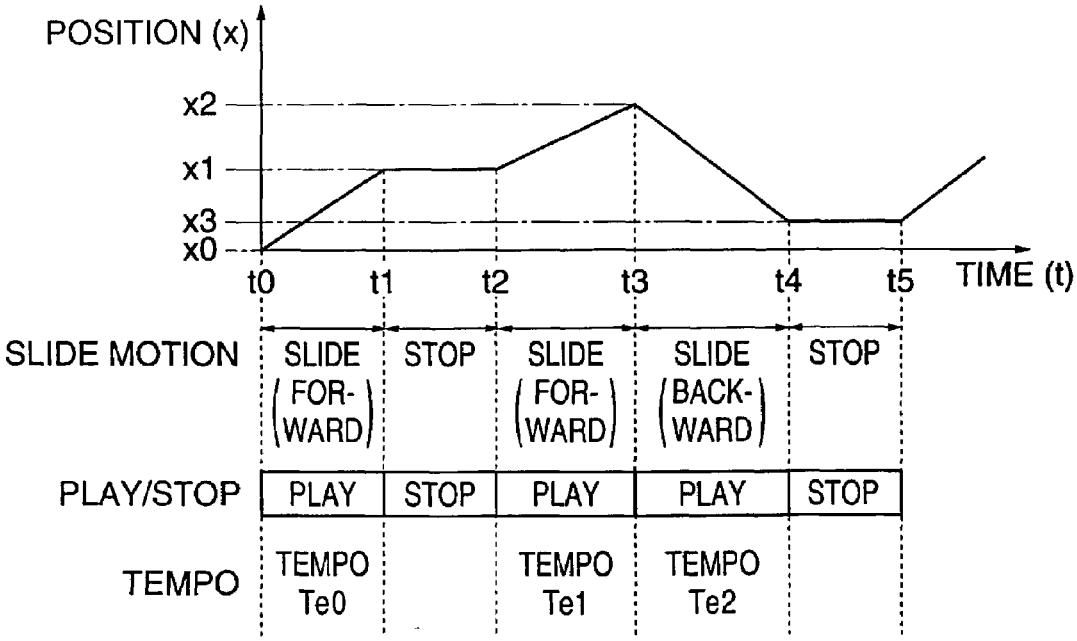
FIG. 12 is a view useful in explaining the operation of a musical tone control apparatus according to a second embodiment of the present invention.

First, the operator designates a musical piece to be played and moves the slider 22 as desired. In FIG. 12, the slider 22 is seen to be moved from an initial position x0 to a position x1 from a time point t0 at which the slide motion is started to a time point t1 at which a predetermined time period has elapsed. Upon detecting that the slider 22 is being moved, from the displacement signal output from the displacement sensor 111, the controller 15 reads musical piece data from the storage device 12 and then sequentially outputs, to the tone generator device 13, various data contained in the musical piece data, such as interval data (note number) designating the interval, note-on events designating generation of musical tones, and note-off events designating the stoppage of the musical tones (these data will be collectively referred to as "performance data"). The controller 15 sequentially outputs these performance data until the slider 22 is stopped at the time point t1. On this occasion, the controller 15 outputs the performance data at time intervals based on a tempo Te0 (initial value) preset to an initial value. On the other hand, the tone generator device 13 generates musical tone signals based on these performance data and outputs them to the sound speaker system 14. As a result, the speaker 141 of the sound speaker system 14 sequentially outputs musical tones based on the musical piece data, according to the tempo Te0.

On the other hand, upon detecting that the slide motion of the slider is stopped (time point t1), from the displacement signal output from the displacement sensor 11, the controller 15 stops outputting performance data to the tone generator device 13. As a result, the output of musical tones from the speaker 141 is also stopped. Furthermore, the controller 15 calculates the average speed of the slide motion so far made and stores it in the storage device 12. For example, if the slider moves from position x0 to position x1 during the period from time point t0 to time point t1 as described above, the average speed v1 of this slide motion is determined by dividing the displacement (x1−x0) of the slider 22 by the time period (t1−t0) required for the slide motion.

On the other hand, when the slider 22, which has been stopped, starts to be moved again at a time point t2, the controller 15 sequentially outputs performance data contained in the musical piece data to the tone generator device 13. On this occasion, the controller 15 outputs the performance data so that the musical piece is played at a tempo Te1 corresponding to the average speed v1 stored previously in the storage device 12 (i.e. the average speed of the preceding slide motion). For example, if the average speed v1 is relatively high, the controller 15 outputs the performance data so that the musical piece is played at a fast tempo. In contrast, if the average speed v1 is relatively low, the controller 15 outputs the performance data so that the musical piece is played at a slow tempo. Such change of the tempo can be effected using various well-known techniques. For example, one possible method is to divide the frequency of a reference clock signal according to the average speed v1 so that the performance data is output in synchronism with the thus obtained clock signal. Thus, the performance data is output at time intervals corresponding to the average speed v1. Consequently, the musical piece is played based on the musical piece data, at the tempo Te1 corresponding to the average speed v1.

Then, when at a time point t3, the moving direction of the slider 22 is reversed, i.e. the slider 22 is switched from movement in a direction in which the slider 22 is drawn out from the support section 21 to movement in a direction in which the slider 22 is inserted into the support section 21, the controller 15 calculates the average speed v2 of the preceding slide motion made from time point t2 to time point t3. For example, in FIG. 12, the average speed v2 is (x2−x1)/(t3−t2). In response to a slide motion after the time point t3, the controller 15 outputs performance data so that the musical piece is played at a tempo Te2 corresponding to the average speed v2. As a result, in response to the slide motion from time point t3 to time point t4, the musical piece is played at the tempo Te2. Thereafter, the above described operation is repeated until the operator completes playing the musical piece.

In this way, according to the present embodiment, while a slide motion is being made, a musical piece is played based on musical piece data, whereas, while no sliding motion is being made, the performance of the musical piece is stopped. As a result, even beginners, who are unaccustomed to playing a musical instrument, can easily play a musical piece. On the other hand, the operator's motion can be reflected in the performance, thereby avoiding spoilage of the operator's feeling that he is actually playing the musical piece. Further, according to the present embodiment, the performance tempo of the musical piece corresponding to a slide motion made during a certain time period is properly varied depending on the contents of the preceding slide motion (average speed of the motion). Therefore, the operator can very easily reflect his own expressions in performance of the musical piece.

In the above description, the slider-type musical tone control apparatus is illustrated. However, a similar construction can be employed for the musical tone control apparatuses of the other types shown in FIGS. 8 to 11. For example, with the accordion-type musical tone control apparatus 1*b* shown in FIG. 8, it may be so arranged that a musical piece is played while the pair of body portions 32 and 33 are being opened or closed, and in response to an opening or closing motion made during a certain time period, the musical piece is played at a tempo corresponding to the average speed of the preceding motion. Furthermore, with a string instrument—type musical tone control apparatus which is shaped like a violin as shown in FIG. 9 or like an acoustic guitar as shown in FIG. 10, it may be so arranged that a musical piece is played during a certain time period when the string 43 is being vibrated, and in response to a picking motion made at a certain time point, the musical piece is played at a tempo corresponding to the contents of the preceding picking motion (for example, the intensity of the picking).

Further, in the above embodiments, the unit time period after which the performance tempo of the musical piece is changed is a time period in which a certain motion has been continuously made (for example, the slider 22 has been continuously moved in one direction). However, the unit time period may be set as follows: that is, the average speed of a motion made during each time period is calculated, and the average speed calculated for each time period can be reflected in the performance tempo of the musical piece executed during the next time period. Thus, the operator's motion can be more minutely reflected in the performance tempo of the musical piece.

The above described embodiments are only illustrative, and variations may be made thereto without deviating from the spirits of the present invention. For example, the following variations are possible:

The types of motions to be detected such as a slide motion or a picking motion are not limited to those shown in the above embodiments. That is, in the above embodiments, with the slider-type musical tone control apparatus shown in FIG. 3, a slide motion made on the slider is detected. With the accordion-type musical tone control apparatus shown in FIG. 8, an opening or closing motion made on the opposite body portions is detected. With the string instrument-type musical tone control apparatus shown in FIG. 9 or 10, a picking motion or a string rubbing motion made on the strings is detected. However, motions to be detected are not limited to these types. Accordingly, the type of the operating element operated by the operator is not limited to the slider 22, the first and second body portions, and the strings 43, but other types of operating element may be employed.

Further, characteristics of musical tones to be controlled in amount (characteristic amounts) according to the operator's motion are not limited to those shown in the above described embodiments. That is, although in the above described first embodiment, tone generation timing and volume are controlled according to the motion, and in the second embodiment, tempo and volume are controlled according to the motion, in addition to these characteristics, the tone color of musical tones, effects applied to the musical tones, and the like may be controlled. For example, it is possible that the tone color of musical tones is changed and/or effects (for example, reverberation) are applied to musical tones to be output, according to the operator's motion. That is, of the characteristics relating to musical tones, at least the interval may be determined in amount to be controlled, based on the musical piece data, whereas at least one of the other characteristics may be determined in amount to be controlled, according to the operator's motion (i.e. according to the contents of the motion signal output from the motion sensor 11).

Furthermore, the manner of determining the contents of control of the characteristic amounts is not limited to those shown in the above described embodiments. For example, in the above described embodiments, the volume of musical tones is controlled according to the posture of the musical tone control apparatus. However, with the string instrument-type musical tone control apparatus shown in FIG. 9 or 10, the volume may be controlled according to the amplitude of vibration applied to the strings 43.

In the above described embodiments, musical tone output devices such as the tone generator device 13 and the sound speaker system 14 are provided in one body with the musical tone control apparatus. However, these devices may be provided in separate bodies from the musical tone control apparatus. Specifically, data output from the controller 15 of the musical tone control apparatus may be supplied via a signal line to the tone generator device 13 and sound speaker system 14 which are provided at a distance from the musical tone control apparatus. The forms shown in FIGS. 3 and 8 to 11 are only examples of the musical tone control apparatus according to the present invention. The scope of the present invention is not limited to these forms.

The above described first embodiment employs a playing method in which musical tones are sequentially output whenever the operator makes a specific motion. The above described second embodiment employs a playing method in which performance of musical tones is progressed while the operator is making a specific motion. However, a single musical tone control apparatus may be provided, that can realize both the playing methods so that the operator can select one of the methods as desired.

In the first embodiment, when the operator stops a specific motion, the output of a musical tone is immediately stopped. However, the musical tone control apparatus according to the present invention may be so configured that after the operator has stopped a specific motion, reverberation is added to the musical tone to be stopped for a predetermined time period. This avoids the musical tone from being suddenly stopped, thereby enabling more natural performance.

What is claimed is:

1. A musical tone control apparatus comprising:

a storage device that stores musical piece data containing interval data indicative of intervals of musical tones constituting a musical piece;

an operating element comprising a pair of members joined together via a telescopic joining member, a detecting device that detects a start and stop motion of the operating element;

a controller that provides control so as to instruct a musical tone output device capable of outputting musical tones to adopt the intervals as one of characteristic amounts relating to musical tones to be output from the musical tone output device, according to the input interval data, and instruct the musical tone output device to adopt at least one of the characteristic amounts relating to musical tones other than the intervals, including note duration, to be output from the musical tone output device, according to the musical piece data, according to the start motion of the operator detected by said detecting device, and to quit output from the musical tone output device, according to the musical piece data, according to the stop motion of the operator detected by said detecting device;

wherein said controller is responsive to at least one of said pair of members being moved away from each other and said pair of members being moved toward each other according to the start of motion of the operator detected by said detecting device, for instructing the musical tone output device to output at least one associated musical tone of the musical tones constituting the musical piece; and wherein said musical tone output device outputs the musical tones according to the musical interval data when the musical interval data are inputted, and maintains the outout of musical tones until it receive a stop instruction for outout based on the stop motion of the operator detected by said detecting device, whereupon the musical tone outout device puts an end to output the musical tones according to the stop instruction from said controller.

2. A musical tone control apparatus comprising:

a storage device that stores musical piece data containing interval data indicative of intervals of musical tones constituting a musical piece;

said operating element comprising strings that are vibrated in response to the motion of the operator, a detecting device that detects a start and stop motion of the operating element;

a controller that provides control so as to instruct a musical tone output device capable of outputting musical tones to adopt the intervals as one of characteristic amounts relating to musical tones to be output from the musical tone output device, according to the input interval data, and instruct the musical tone output device to adopt at least one of the characteristic amounts relating to musical tones other than the intervals, including note duration, to be output from the musical tone output device, according to the musical piece data, according to the start motion of the operator detected by said detecting device, to quit output from the musical tone output device, according to the musical piece data, according to the stop motion of the operator detected by said detecting device;

wherein said controller is responsive to the strings being vibrated, for instructing the musical tone output device to output at least one associated musical tone of the musical tones constituting the musical piece.

3. A musical tone control apparatus according to claim 1, wherein said controller instructs the musical tone output device to adopt volume corresponding to the motion of the operator as the volume of the musical tones to be output from the musical tone output device.

4. A musical tone control apparatus according to claim 1, wherein said detecting device detects a posture of the musical tone control apparatus which changes depending on the motion of the operator, and said controller instructs the musical tone output device to adopt volume corresponding to the posture of the musical tone control apparatus, as the volume of the musical tones to be output from the musical tone output device.

5. A musical tone control apparatus according to claim 1, wherein said detecting device detects a motion made on said operating element, and said controller instructs the musical tone output device to carry out or stop output of the musical tones based on the musical piece data, depending on the operation detected by said detecting device.

6. A musical tone control apparatus according to claim 5, wherein said controller is responsive to said operating element being operated, for instructing the musical tone output device to carry out the output of the musical tones and responsive to said operating element not being operated, for instructing the musical tone output device to stop the output of the musical tones.

7. A musical tone control apparatus according to claim 6, wherein said controller instructs said musical tone output device to adopt a tempo corresponding to the motion of the operator, as a tempo at which the output of the musical tones is carried out.

8. A musical tone control apparatus according to claim 5, wherein said controller instructs the musical tone output device to adopt a tempo corresponding to the motion of the operator, as a tempo at which the output of the musical tones is carried out.

9. A musical tone control apparatus according to claim 1, wherein the musical tone output device is provided in one body with the musical tone controller.

10. A musical tone control method comprising the steps of:

causing a storage device to store musical piece data containing interval data indicative of intervals of musical tones constituting a musical piece;

detecting a start and stop motion of the operating element; and instructing a musical tone output device capable of outputting musical tones to adopt the intervals as one of characteristic amounts relating to musical tones to be output from the musical tone output device, according to the interval data, and instructing the musical tone output device to adopt at least one of the characteristic amounts other than the intervals, including note duration, according to the detected motion of the operator, wherein the musical tone output device is instructed to output at least one associated musical tone of the musical tones constituting the musical piece when at least one of a pair of members joined together via a telescopic joining member being moved away from each other and said pair of members being moved toward each other according to the start of motion of the operator is occurred; and wherein said musical tone output device outputs the musical tones according to the musical interval data when the musical interval data are inputted, and maintains the output of musical tones until it receive a stop instruction for output based on the stop motion of the operator detected by said detecting device, whereupon the musical tone output device puts an end to output the musical tones according to the stop instruction from said controller.

11. A musical tone control apparatus comprising:

a storage device that stores data corresponding to a musical piece comprised of musical tones;

a detecting device that detects a start and stop motion of the operating element; and a controller that provides control so as to instruct a musical tone output device capable of outputting musical tones to output musical tones based at least in part upon the motion of the operator detected by said detecting device, wherein said controller includes a pair of members joined together via a telescopic joining member, and said controller is responsive to at least one of said pair of members being moved away from each other and said pair of members being moved toward each other according to the start of motion of the operator detected by said detecting device, for instructing the musical tone controller to output at least one associated musical tone of the musical tones constituting the musical piece, and being further responsive according to the stop of motion of the operator detected by said detecting device for instructing the musical tone controller not to output musical tones.

12. A musical tone control apparatus according to claim 11, wherein said controller instructs the musical tone output device to adopt volume corresponding to the motion of the operator as the volume of the musical tones to be output from the musical tone output device.

13. A musical tone control apparatus according to claim 11, wherein said controller detects a posture of the musical tone control apparatus which changes depending on the motion of the operator, and said controller instructs the musical tone output device to adopt volume corresponding to the posture of the musical tone control apparatus, as the volume of the musical tones to be output from the musical tone output device.

14. A musical tone control apparatus for use with a musical instrument comprising:

a storage device that stores data corresponding to a musical piece comprised of musical tones;

a detecting device employing at least one displacement sensor that detects a start and stop of motion of an operator in manipulating the musical instrument, where displacement is measured in reference to a predetermined position on said musical instrument; and a controller that provides control so as to instruct a musical tone output device capable of outputting musical tones to output musical tones based at least in part upon the start motion of the operator detected by said detecting device, wherein said detecting device is operative to cause said controller to instruct the musical tone output device to carry out output of the musical tones only during the time motion is detected by analyzing the output of said displacement sensor.

15. A musical tone control apparatus according to claim 14 wherein said detecting device is operative to cause said controller to instruct the musical tone output device to stop the output of musical tones during the time motion is not detected by analyzing the output of said displacement sensor.

16. The apparatus of claim 14 wherein said musical instrument includes a slider and the displacement is measured in reference to a predetermined position on said slider.

17. A musical tone control apparatus comprising:

a storage device that stores musical piece data containing interval data indicative of intervals of musical tones constituting a musical piece;

an operating element comprising a pair of members joined together via a bellows joining member, a detecting device that detects a start and stop motion of the operating element;

a controller that provides control so as to instruct a musical tone output device capable of outputting musical tones to adopt the intervals as one of characteristic amounts relating to musical tones to be output from the musical tone output device, according to the input interval data, and instruct the musical tone output device to adopt at least one of the characteristic amounts relating to musical tones other than the intervals, including note duration, to be output from the musical tone ouput device, according to the musical piece data, according to the start motion of the operator detected by said detecting device, to quit output from the musical tone output device, according to the musical piece data, according to the stop motion of the operator detected by said detecting device;

wherein said controller is responsive to at least one of said pair of members being moved away from each other and said pair of members being moved toward each other according to the start of motion of the operator detected by said detecting device, for instructing the musical tone controller to output at least one associated musical tone of the musical tones constituting the musical piece, wherein said musical tone output device outputs the musical tones according to the musical interval data when the musical interval data are inputted, and maintains the output of musical tones until it receive a stop instruction for output based on the stop motion of the operator detected by said detecting device, whereupon the musical tone output device puts an end to output the musical tones according to the stop instruction from said controller.

* * * * *